United States Patent [19]

Cassia

[11] 4,173,858

[45] Nov. 13, 1979

[54] SOAP DISPENSING SYSTEM

[75] Inventor: Antonio M. Cassia, Milan, Italy

[73] Assignee: Steiner Corporation, Salt Lake City, Utah

[21] Appl. No.: 880,766

[22] Filed: Feb. 24, 1978

[30] Foreign Application Priority Data

Oct. 6, 1977 [IT] Italy ..... 28347 A/77

[51] Int. Cl.[2] ..... B25B 7/28; B67B 1/08; B65B 51/22; B65B 3/04

[52] U.S. Cl. ..... 53/471; 53/478; 141/18; 141/330

[58] Field of Search ..... 141/2, 18, 3, 20, 1, 141/100, 329, 330, 19, 346, 347, 351, 352; 53/471, 478, 489

[56] References Cited

U.S. PATENT DOCUMENTS

| | | | |
|---|---|---|---|
| 2,849,156 | 8/1958 | Mansted | 141/330 |
| 3,970,121 | 7/1976 | Brandt | 141/2 |

*Primary Examiner*—Houston S. Bell, Jr.

*Attorney, Agent, or Firm*—Vogel, Dithmar, Stotland, Stratman & Levy

[57] ABSTRACT

A liquid soap dispensing system includes a closed soap container having a manually actuated dispensing pump carried therebeneath. Refill of the container is by a plastic refill squeeze bottle with a neck defining an outlet opening closed by a membrane recessed therein. One embodiment of the bottle is formed by ultrasonically welding in the neck end, after the bottle is filled, a plug defining a cylindrical sleeve closed at the inner end thereof by a closure wall. The neck is inserted into a well in the top of the container, and a hollow piercing member at the bottom of the well ruptures the membrane or closure member, whereupon soap may be squeezed from the bottle and through the passage through the hollow piercing member, which is constricted by septa dividing the passage into channels such that flow of liquid soap therethrough at equal pressures at both ends of the passage is substantially inhibited. The piercing member is in sealing engagement with the plug sleeve, and annular ribs on the neck are in sealing engagement with the well side wall.

25 Claims, 12 Drawing Figures

SOAP DISPENSING SYSTEM

BACKGROUND OF THE INVENTION AND PRIOR ART STATEMENT

The present invention relates to apparatus for dispensing liquid soap, normally in discrete small quantities or charges. More particularly, the present invention relates to refillable liquid soap dispensers having an "anti-bootleg" feature, i.e., a dispenser designed so that it can be refilled only with soap from a particular type of refill cartridge.

The present invention is an improvement of the soap dispensing system disclosed in my copending U.S. application Ser. No. 719,924, filed Sept. 2, 1976, now abandoned, and assigned to the assignee of the present invention, the disclosure of which copending application is incorporated herein by reference.

In the dispensing system of my aforementioned copending application, the liquid soap container is refilled by inserting the neck of a plastic squeeze bottle into a well in the top wall of the container, a closure membrane across the end of the bottle neck being pierced by a solid piercing member in the well, whereupon the liquid soap could be squeezed and forced through small apertures in the bottom of the well communicating with the interior of the container. But the squeeze bottle was sealed by a thin membrane across the outer end of the neck, where it could readily contact foreign objects during storage or shipment and handling, creating a danger of accidental puncture of the membrane and consequent leakage of the liquid soap from the squeeze bottle.

Furthermore, this prior arrangement was such that it necessitated liquid soap contacting and accumulating on the bottom wall of the well. Particularly upon removal of the squeeze bottle a certain residue would necessarily be left in the well and, while this residue might eventually drain through the openings in the well bottom, it would tend to dry up and clog the openings in between refills and, at the very least, would leave an unsanitary deposit on the well bottom.

The Brandt U.S. Pat. No. 3,970,121, a copy of which is filed herewith, discloses a refill injection bottle for refilling a pressurized spray container. But Brandt is not concerned with the "anti-bootleg" function. He discloses a bottle having a neck insertable into a well on the container, the neck being plugged with a stopper which is pierced by a hollow tube in the well through which liquid would flow readily by gravity, except for the presence of a check valve in the pressurized container. The Brandt "well" is completely external of his container and his plug is at the outer end of his bottle neck, susceptible to contact by foreign objects. Furthermore, the stopper for Brandt's squeeze bottle is a relatively thick member 66, and it appears that the hollow tubular perforating member 50 might tend to core out of the stopper a small core of material which would, in turn, plug the hollow perforating member or, at the very least, seriously impede the flow of liquid soap therethrough.

SUMMARY OF THE INVENTION

The present invention relates to an improved liquid soap dispensing system which avoids the deficiencies of prior art systems, while affording important advantages.

It is an important feature of the present invention that there is provided a liquid soap dispensing system including a refillable container and a refill squeeze bottle, the container having a piercing member which is received in the neck of the squeeze bottle to puncture a closure membrane recessed therein to protect against accidental rupture.

It is another feature of this invention that the piercing member is hollow to form a refill passage therethrough and the squeeze bottle neck is closed by a plug including a sealing sleeve which is disposed in sealing relationship with the piercing member to prevent the flow of liquid soap around the outside of the piercing member.

Another feature of this invention is that the piercing member is disposed in a well which extends inwardly of the refillable container, the squeeze bottle neck being received into this well during refill of the container.

It is another feature of this invention that the injection squeeze bottle is formed by welding a plug in the bottle neck after the bottle is filled.

These features are provided and it is an important object of this invention to attain these advantages by providing a liquid soap dispensing system comprising a soap injection cartridge containing liquid soap and having a cylindrical neck terminating at a discharge end, a closure member disposed within and sealing the neck and spaced from the discharge end for protection against accidental rupture, dispensing apparatus including a closed wall structure defining a soap container from which soap is to be dispensed, the wall structure having a refill aperture therethrough dimensioned to inhibit the flow of liquid soap therethrough at equal pressure on both sides of the wall structure, and a piercing member carried by the container and projecting outwardly therefrom adjacent to the refill aperture for entering the neck and piercing the closure member, the soap injection cartridge including means for placing the soap therein under pressure greater than that in the container for forcing the liquid soap through the refill aperture at a substantial rate after piercing of the closure member.

Another object of this invention is to provide a refillable liquid soap dispenser of the type set forth.

Still another object of this invention is to provide a liquid soap injection cartridge of the type set forth.

Further features of the invention pertain to the particular arrangement of the parts of the liquid soap dispensing system and the steps of the method of forming the injection cartridge whereby the above-outlined and additional operating features thereof are attained.

The invention, both as to its organization and method of operation, together with further objects and advantages thereof, will best be understood by reference to the following specification taken in conjunction with the accompanying drawings.

DESCRIPTION OF THE PREFERRED EMBODIMENTS

Figure 1:
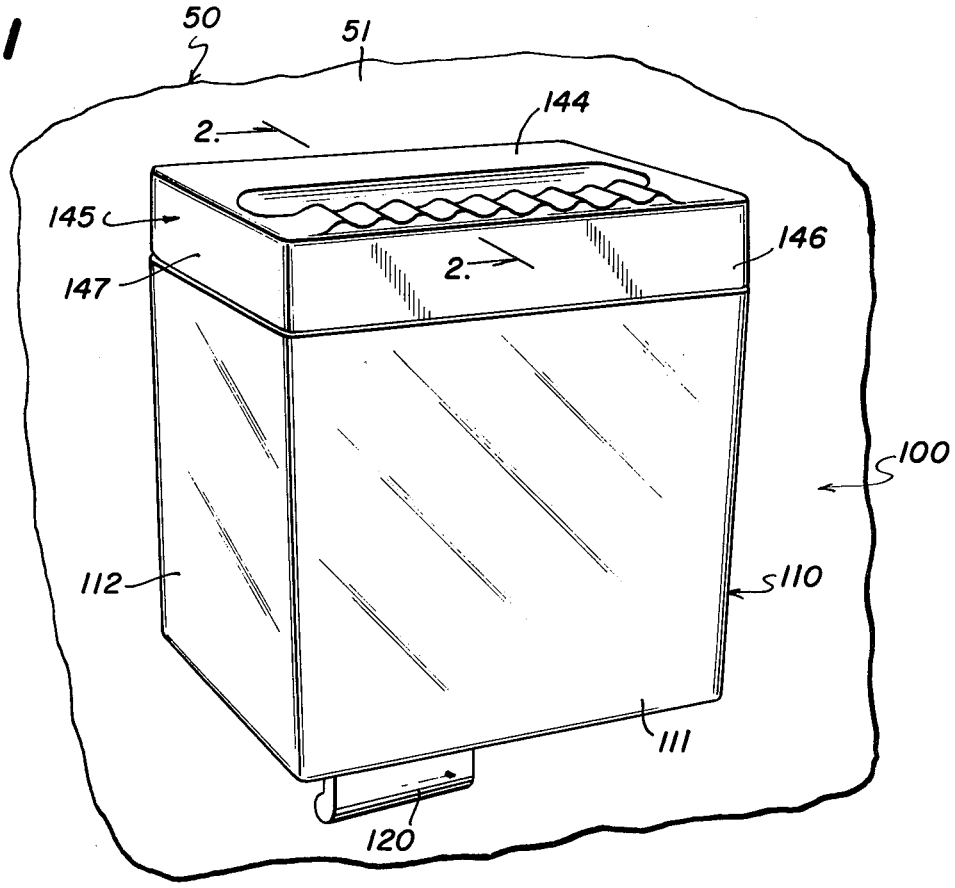
FIG. 1 is a perspective view of a refillable liquid soap dispenser constructed in accordance with and embodying the features of the present invention.
Figure 2:
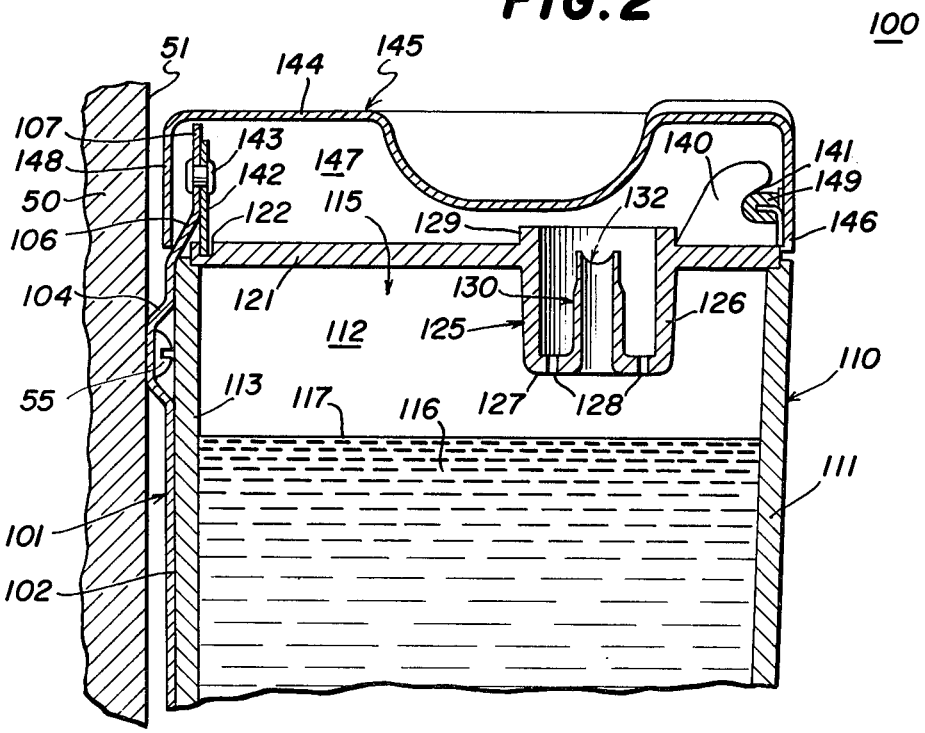
FIG. 2 is an enlarged fragmentary view in vertical section taken along the line 2—2 in FIG. 1.

Referring now to FIGS. 1 and 2 of the drawings, there is illustrated a soap dispenser, generally designated by the numeral 100, constructed in accordance with and embodying the features of the present invention, and mounted on the surface 51 of a wall 50. The soap dispenser 100 is similar to the soap dispenser 100 illustrated in my aforementioned copending application Ser. No. 719,924, and, therefore, many structural details which are common to the two soap dispensers are omitted herein and reference may be made to the copending application for a fuller description of those details.

The soap dispenser 100 includes a mounting bracket, generally designated by the numeral 101, which includes a generally flat rectangular wall 102 disposed substantially vertically in use to provide a bearing surface. Formed in the vertical wall 102 and projecting rearwardly therefrom are two substantially vertically aligned generally frustoconical embossments 104 (one shown), each having an opening extending therethrough centrally thereof for receiving a screw 55 for fastening the mounting bracket 101 to the wall 50. Integral with the wall 102 at the upper end thereof is an extension flange 109 which is inclined forwardly, and which is integral at the distal end thereof with an upwardly extending flange 110 which is substantially parallel to the wall 102. Integral with the bottom end of the wall 102 and extending forwardly therefrom substantially normal thereto is a bottom wall (not shown) disposed substantially horizontally in use and carrying a pumping mechanism (not shown), for a purpose to be described more fully below.

The dispenser 100 also includes a soap container or housing, generally designated by the numeral 110, which is preferably formed of plastic. The container 110 is generally box-like in configuration, and includes a generally rectangular front wall 11, a pair of opposed side walls 112, a rear wall 113 and a rectangular bottom wall (not shown), the container 110 preferably being molded so that the walls 111–113 and the bottom wall are all formed integrally with one another. The container 110 is supported on the horizontal wall of the mounting bracket 101, in a manner more fully described in the aforementioned copending application Ser. No. 719,924, which is now abandoned.

The walls of the container 110 cooperate to define therewithin a soap chamber, generally designated by the numeral 115 which, in use, is filled with liquid soap 116 to a predetermined level, such as 117. Secured to the bottom wall of the container 110 is a pump assembly (not shown) which is engaged by one arm of a manually operated pump lever 120 for dispensing measured amounts of liquid soap from the container 110, in a manner described in detail in the copending application Ser. No. 719,924.

Figure 6:
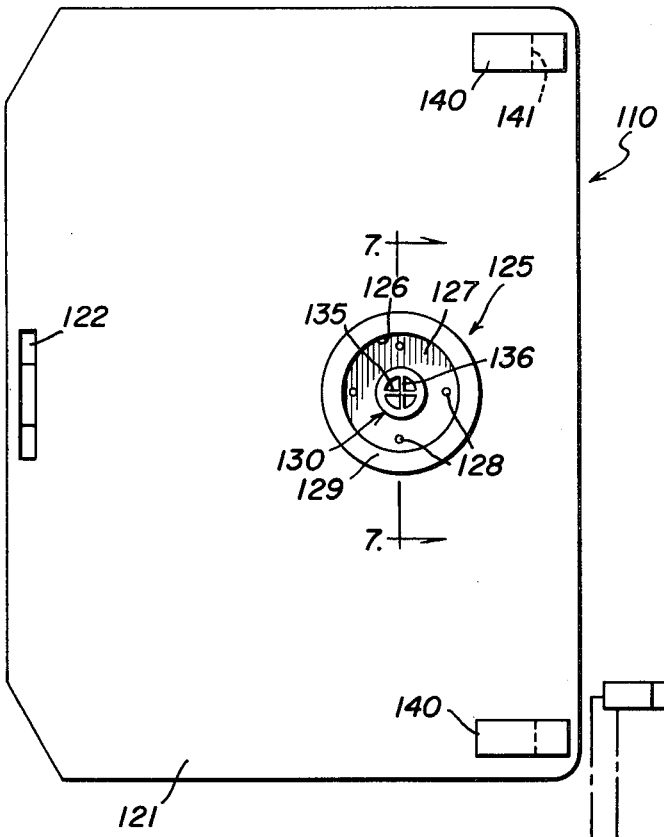
FIG. 6 is a top plan view of the soap dispenser of the present invention, with the top cover thereof removed.
Figure 7:
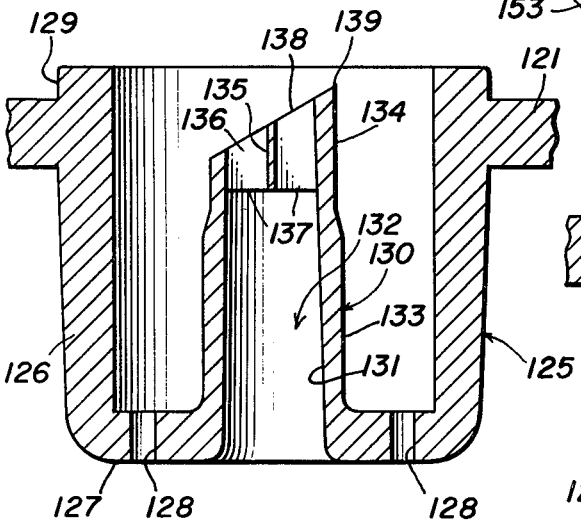
FIG. 7 is an enlarged fragmentary view in vertical section taken along the line 7—7 in FIG. 6.

Referring now also to FIGS. 6 and 7 of the drawings, the container 110 is provided with a top wall 121 which is fixedly secured to the upper ends of the container walls 111–113 for closing the upper end of the chamber 115. Formed in the upper surface of the top wall 121 adjacent to the rear edge thereof is a narrow groove or recess 122. Also formed in the top wall 121 is a deep cylindrical depending well, generally designated by the numeral 125, which is provided with a generally cylindrical side wall 126 closed at the bottom end thereof by a circular bottom wall 127. Formed in the bottom wall 127 around the periphery thereof are a plurality of spaced-apart small drain holes 128 which communicate with the soap chamber 115. The well side wall 126 extends upwardly a predetermined slight distance above the upper surface of the top wall 121 to form a raised lip portion 129.

Integral with the bottom wall 127 of the well 175 and projecting upwardly therefrom substantially centrally thereof and coaxially therewith is a hollow tubular piercing member, generally designated by the numeral 130. The piercing member 130 has a generally cylindrical inner surface 131 which may taper slightly inwardly toward the upper end thereof, and defines a passage 132 therethrough, and a cylindrical outer surface 133 having a reduced diameter portion 134 at the upper end thereof. Formed within the piercing member 130 at the upper end thereof integral therewith are two flat septa or dividers 135 and 136 which intersect at right angles to each other substantially along the longitudinal axis of the piercing member 130 to form a cross which divides the upper end of the passage 132 into four channels. The bottom edges of the dividers 135 and 136 are disposed just above the lower ends of the reduced diameter portions 133 of the outer surfaces of the piercing member 130, the upper ends of the dividers 135 and 136 being flush with the top of the piercing member 130 which is inclined, as at 138, to define a sharp point 139 at the upper end thereof, the point 139 being disposed just below the top of the well side wall 126, but just above the level of the container top wall 121.

Integral with the top wall 121 and projecting upwardly therefrom adjacent to the front corners thereof are two lugs or ears 140, each being provided with an arcuate recess 141 defining a retaining surface in the forward edge thereof. Pivotally secured to the inner surface of the upwardly extending flange 107 of the mounting bracket 101, as by a rivet 143, is a small circular retaining plate 142, preferably formed of metal. The retaining plate 142 extends downwardly to a point adjacent to the bottom end of the inclined flange 106.

In use, when the container 110 is mounted on the mounting bracket 102, the retaining plate 142 is pivoted upwardly out of the way to permit the top wall 121 to pass thereunder, and then when the container rear wall 113 is against the bracket wall 102, the retaining plate 142 is pivoted back down into the groove 122 for cooperation with the mounting bracket 101 securely to hold the container 110 in place and prevent it from tipping forward.

The dispenser 100 is also provided with a cover plate, generally designated by the numeral 145, which includes a top wall 144, a front wall 146, a pair of opposed side walls 147 and a rear wall 148, all integrally connected in a unitary structure. Formed in the top wall 191 is a large bowl-like recess which serves as an ashtray substantially centrally of the cover plate 145, the top wall 144 also having formed therein between the ashtray and the front wall 146 a plurality of flutes to serve as cigarette holders. Fixedly secured to the inner surface of the front wall 146 adjacent to the opposite side edges thereof are two projections 149 which are respectively adapted to be received in the arcuate recesses 141 of the lugs 140 on the container 130 for engagement with the retaining surfaces formed thereby. The cover plate 145 is dimensioned so as to completely cover the top wall 121 of the container 110, with the walls 146–148 having a depth sufficient to accommodate the inclined flange 106 and the upwardly extending flange 107 of the mounting bracket 101. In use, the projections 149 are inserted into the arcuate recesses 141 of the lugs 140, and the cover plate 145 is then pivoted down into position completely covering the top of the container 110, as illustrated in FIG. 2. The cover plate 145 may be provided with a lock mechanism (not shown) for locking the cover plate 145 in place and protecting the well 125 from unauthorized users.

Figure 3:
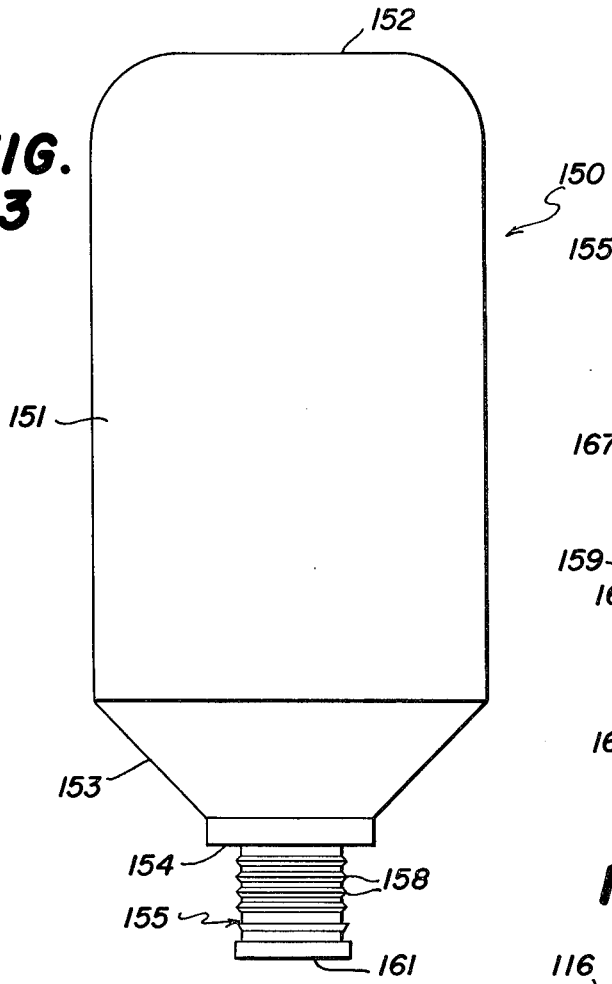
FIG. 3 is a side elevational view of a refill injection cartridge constructed in accordance with and embodying the features of the present invention.
Figure 5:
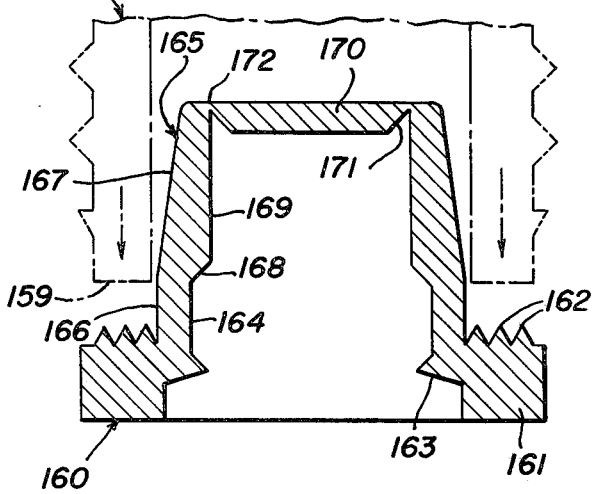
FIG. 5 is a view similar to FIG. 4, of the plug portion of the injection bottle neck, illustrating the manner of assembly thereof with the remainder of the injection bottle neck.
Figure 4:
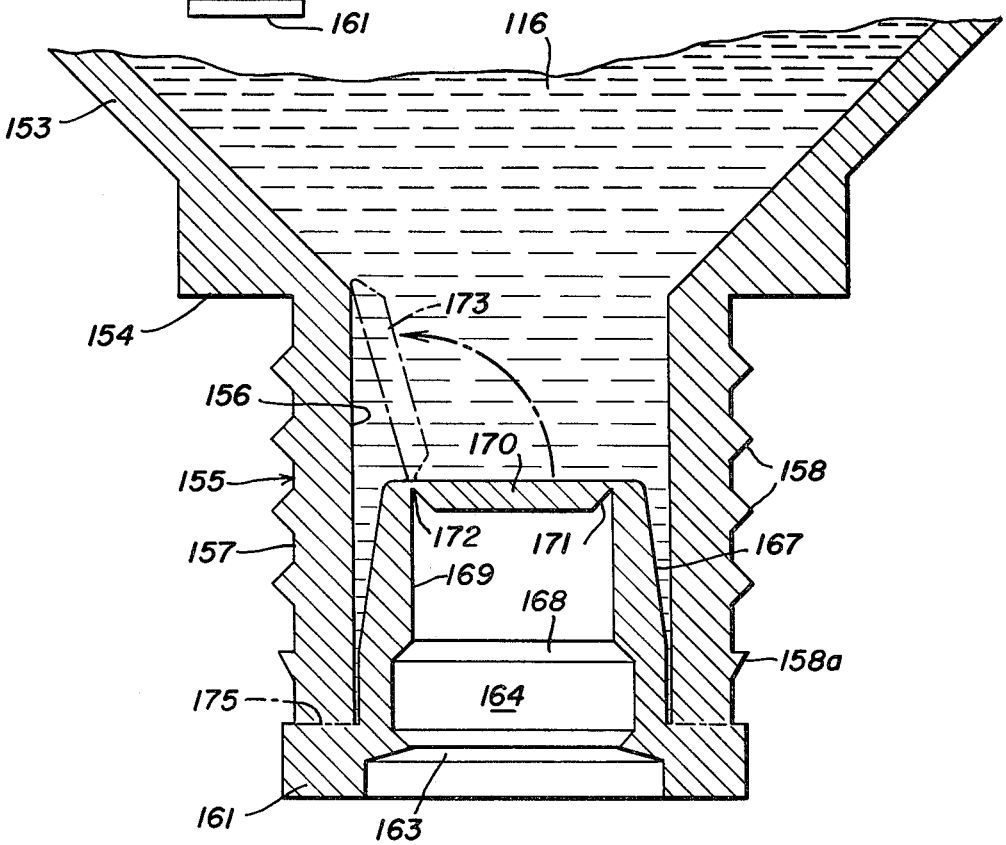
FIG. 4 is an enlarged fragmentary view in vertical section of the neck portion of the refill injection bottle of FIG. 3, illustrating the position of the closure member when pierced by a piercing member.

Referring now also to FIGS. 3 through 5 of the drawings, there is illustrated a refill cartridge or bottle generally designated by the numeral 150, for use with the dispenser 100 to provide a complete liquid soap dispensing system. The refill bottle 150 is preferably in the form of a soft plastic squeeze-bottle and is adapted to hold a refill or supply of liquid soap for refilling the soap container 110 of the dispenser 100. The refill bottle 150 includes an elongated right circular cylindrical side wall 151 closed at one end thereof by a circular bottom wall 152, and having integrally connected thereto at the other end thereof an inwardly sloping frustoconical top wall 153 which terminates in a flat annular shoulder 154. Integral with the annular shoulder 154 and extending outwardly therefrom coaxially therewith is a cylindrical neck, generally designated by the numeral 155, which is substantially thicker and more rigid than the walls 151–153, and includes a cylindrical inner surface 156 and an outer surface 157. Integral with the outer surface 157 and projecting radially outwardly therefrom are a plurality of longitudinally spaced-apart annular ribs 158, each substantially triangular in transverse cross section. Also integral with the outer surface 157 and extending radially outwardly therefrom adjacent to the outer end thereof is a short annular lead rib 158*a*, which is somewhat smaller than the ribs 158. The neck 155 terminates in an annular end surface 159.

The neck 155 is adapted to be terminated by a plug, generally designated by the numeral 160, and preferably of the same type of plastic as the bottle 150. The plug 160 includes an annular body 161 provided along the upper surface thereof with a plurality of radially spaced-apart annular teeth 162. Integral with the annular body 161 along the inner surface thereof and extending radially inwardly thereof is an annular inner projection 163. Integral with the projection 163 and extending axially therefrom is a cylindrical spout or sleeve 165 having along the end thereof adjacent to the annular body 161 an inner cylindrical surface 164 and an outer cylindrical surface 166. The outer cylindrical surface 166 joins a frustoconical outer surface 167 sloping radially inwardly toward the distal end of the sleeve 165. The inner cylindrical surface 164 is joined at the upper end thereof by a radially inwardly sloping shoulder 166 to a cylindrical sealing surface 169 having an inner diameter substantially the same as the outer diameter of the surface 133 of the piercing member 130 of the soap dispenser 100. Integral with and closing the distal end of the cylindrical sleeve 65 is a circular closure wall 170. Formed in the closure wall 170 along the outer periphery of the inner surface thereof is a deep annular recess 171, generally V-shaped in transverse cross section. The portion of the closure wall 170 at the base of the recess 171 defines a thin bridge portion 172 for a purpose to be explained more fully below.

In use, after the bottle 150 has been filled with liquid soap, the cylindrical sleeve 165 of the plug 160 is inserted into the neck 155 of the bottle 150, the cylindrical outer surface 166 of the sleeve 165 having an outer diameter slightly less than the diameter of the inner cylindrical surface 156 of the neck 155. The teeth 162 of the plug 160 are pressed firmly into engagement with the end surface 159 of the neck 155 and the annular body 161 is then ultrasonically welded to the neck 155, the teeth 162 providing the plastic material which flows to form the weldment, indicated at 175 in FIG. 4. When the plug 160 is thus welded in place, it seals the neck 155 and prevents escape of the liquid soap 116 from the bottle 150. It will be noted that the closure wall 170 is disposed about halfway down the neck 155 and is, therefore, protected from accidental engagement with and rupture by foreign objects in handling or storage of the bottle 150.

Figure 8:
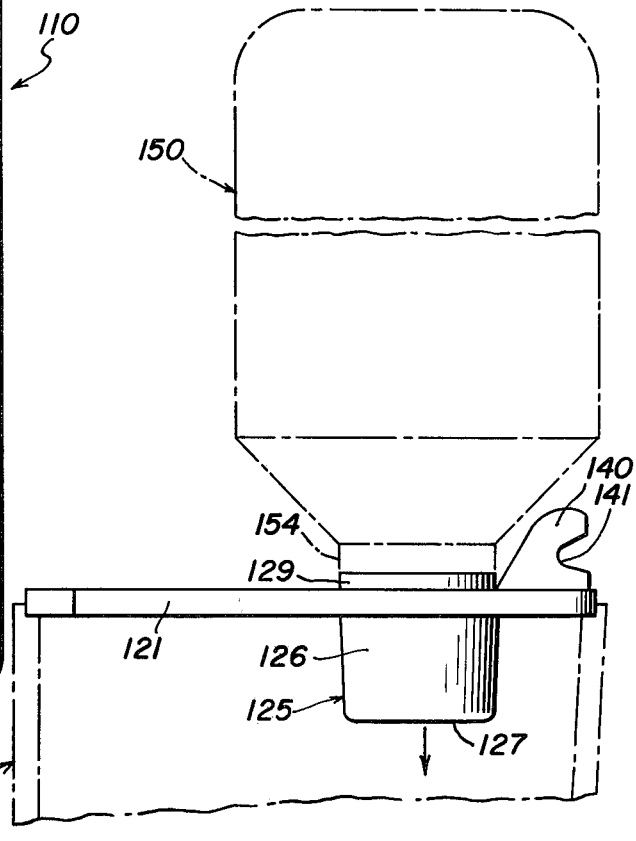
FIG. 8 is a fragmentary side elevational view of the well of the soap dispenser of FIG. 6, illustrating the injection bottle inserted therein.
Figure 9:
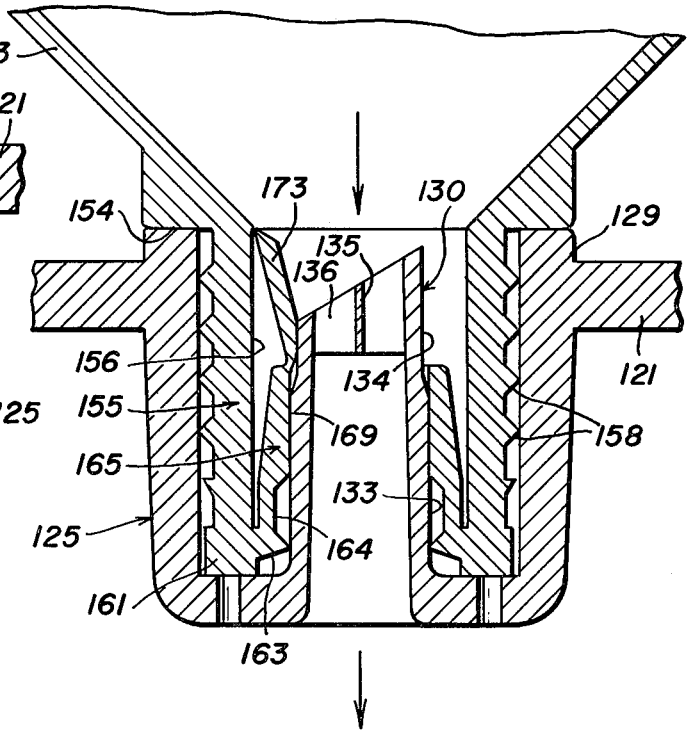
FIG. 9 is an enlarged fragmentary view in vertical section, similar to FIG. 7, but illustrating the well with the neck of the injection bottle of FIG. 3 inserted therein.

Referring now also to FIGS. 8 and 9 of the drawings, when it is desired to refill the soap container 110 of the dispenser 100, the cover plate 145 is unlocked and removed to expose the refill well 125. The neck 155 of the refill bottle 150 is then inserted into the well 125 of the soap container 110. In this regard, it will be noted that the maximum outer diameter of the ribs 158 are substantially equal to the diameter of the inner surface of the well side wall 126 so as to be disposed in frictional sealing engagement therewith as the neck 155 is inserted into the well 125, the ribs 158 being sufficiently resilient to permit insertion of the neck 155 all the way into the well 125 until the annular body 161 of the plug 160 contacts the bottom wall 127 of the well 125 and the shoulder 154 of the bottle 150 engages the upper surface of the raised lip portion 129 of the well 125. It will be noted that when thus fully inserted, the annular body 161 of the plug 160 overlies and closes the upper ends of the drain holes 128 in the well bottom wall 127.

As the neck 155 is inserted into the well 125, the piercing member 130 is received into the spout or sleeve 165 of the plug 160, with the projection 163 and the sealing surface 169 of the plug 160 being disposed in sliding sealing engagement with the outer surface 133 of the piercing member 130. The sharp point 139 of the piercing member 130 enters the annular recess 171 at the right-hand side of the closure wall 170, as viewed in FIG. 9 and pierces or cuts through the thin bridge portion 172 at that point. As the spout or sleeve 165 continues its downward movement over the piercing member 130, the slanted top 138 continues to engage and cut through the bridge portion 172 around the opposite sides of the closure wall 170 until the piercing member 130 has passed entirely through the closure wall 170, as illustrated in FIG. 9. Because of the reduced diameter portion 134 of the outer surface of the piercing member 130, it does not completely sever the closure wall 170, but rather pushes it back upwardly out of the way to form a flap 173 which remains connected to the sleeve 165 by the unsevered part of the bridge portion 172 and is held by the piercing member 130 in engagement with the inner surface 156 of the neck 155 so as not to interfere with the flow of liquid soap through the passage 132 through the piercing member 130.

When the refill bottle 150 is squeezed, the liquid soap therein is placed under pressure greater than that in the container 110 and is forced through the channels formed by the dividers 135 and 136 and thus through the passage 132 in the piercing member 130 into the chamber 115 inside the container 110. The sealing engagement between the outer surface 133 of the piercing member 130 and the projection 163 and sealing surface 169 of the plug 160 prevent the liquid soap from flowing around the outside of the piercing member 130. Furthermore, it will be noted that the dividers 135 and 136, together with the thinness of the closure wall 170 and particularly the bridge portion 172 thereof, assist in pushing the flap 173 back out of the way and prevent the piercing member 130 from coring a hole through the closure wall 170.

Thus, this arrangement prevents a loose core of material from being formed which might float free in the neck 155 or become jammed in the passage 132, in either event hindering or obstructing flow of liquid soap through the passage 132.

After the bottle 150 has been emptied, it is removed from the well 125, the sliding and sealing engagement of the inner projection 163 and sealing surface 169 of the plug 160 with the outer surface 133 of the piercing member 130 serving to wipe any residue of liquid soap from the outer surface of the piercing member 130. If, however, any liquid soap is accidentally spilled into the bottom of the well 125 around the outside of the piercing member 130, it will eventually drain through the drain holes 128 into the container 110. It will be appreciated that the formation of the well 125 extending inwardly of the container 110 prevents the escape of liquid soap from the container 110 through the drain holes 128 or the passage 132 when the container 110 is removed from the mounting bracket 101 and inverted for replacement, service or the like. In this event, any residue of liquid soap remaining in the chamber 115 will collect along the top wall 121, but normally not to a sufficient depth to cover the bottom wall 127 of the well 125.

Figure 10:
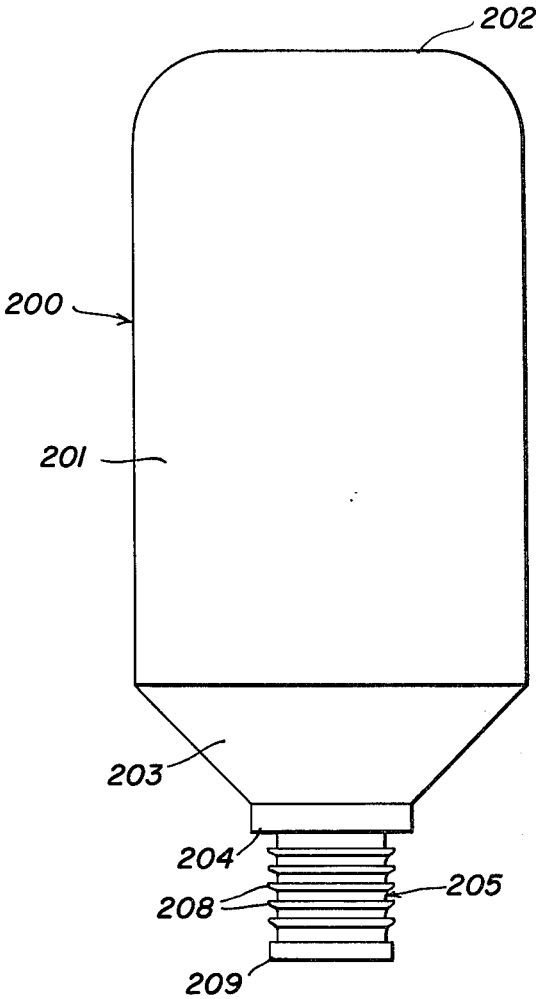
FIG. 10 is a side elevational view, like FIG. 3, of a second embodiment of the refill injection bottle of the present invention.
Figure 11:
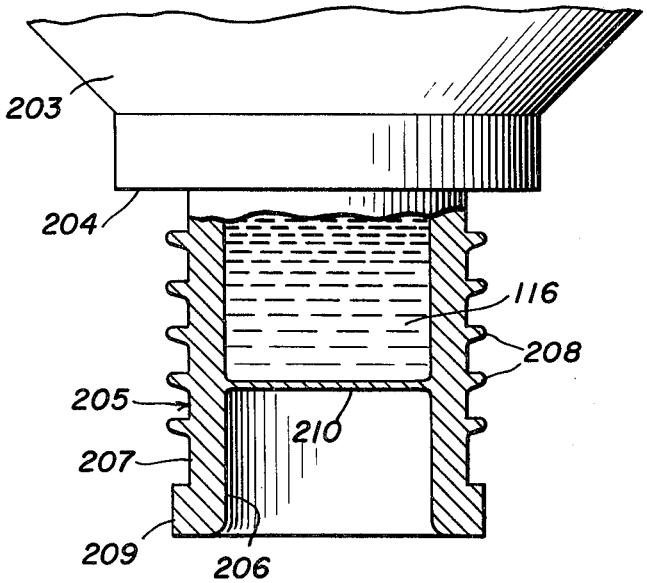
FIG. 11 is an enlarged fragmentary view in partial vertical section of the neck portion of the injection bottle of FIG. 10.
Figure 12:
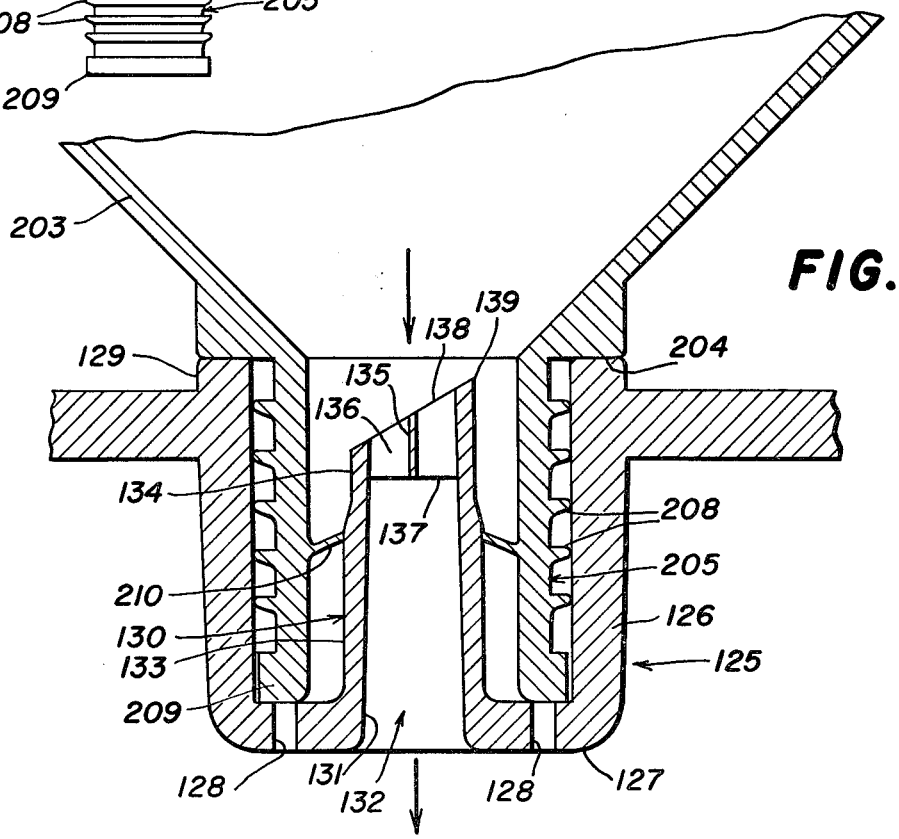
FIG. 12 is a further enlarged fragmentary view in vertical section, like FIG. 9, showing the injection bottle of FIG. 10 inserted into the soap dispenser well.

Referring now also to FIGS. 10 through 12 of the drawings, there is illustrated a second embodiment, generally designated by the numeral 200, of a refill injection bottle constructed in accordance with the present invention. The refill bottle 200 is preferably in the form of a soft plastic squeeze-bottle and includes an elongated right circular cylindrical side wall 201 closed at one end thereof by a circular bottom wall 202, and having integrally connected thereto at the other end thereof an inwardly sloping frustoconical top wall 203 which terminates in an annular shoulder 204. Integral with the shoulder 204 and extending axially therefrom is a cylindrical neck, generally designated by the numeral 205, which is substantially thicker and more rigid than the walls 201 through 203, and includes a cylindrical inner surface 206 and an outer surface 207. Integral with the outer surface 207 and extending radially outwardly therefrom are a plurality of axially spaced-apart annular ribs 208. The neck 205 terminates in a thickened outer end 209. Integral with the inner surface 206 approximately midway between the ends thereof is an annular shoulder 211.

In use, after the bottle 200 has been filled with liquid soap, a circular closure web or membrane 210 having a diameter substantially the same as the diameter of the inner surface 206, is inserted into the opening through the neck 205 and seated against the shoulder 211, where it is ultrasonically welded in place effectively to close and seal the discharge outlet through the neck 205 and prevent the escape of the liquid soap 116 therefrom (see FIG. 11).

In refilling the soap container 110, the neck 205 is inserted into the well 125, in the same manner as was described above in connection with the refill bottle 150. The ribs 208 have a maximum outer diameter such that they are disposed in sliding sealing engagement with the inner surface of the well side wall 126. The neck 205 is inserted until the thickened end portion 209 thereof bottoms on the bottom wall 127 of the well 126, and the shoulder 204 seats against the upper surface of the raised lip portion 129 of the well 125, as illustrated in FIG. 12. As the neck 205 is moved into the seated position, the sharp point 139 and slanted upper edge 138 of the piercing member 130 pierces the membrane 210, thereby to permit the liquid soap to be squeezed from the bottle 200 through the passage 132 in the piercing member 130 under pressure greater than that in the container 110 to refill the chamber 115 of the container 110. Any liquid soap which might seep around the outside of the piercing member 130 eventually drains through the drain holes 128 after the neck 205 has been removed from the well 125. It will be appreciated that the recessed position of the web or membrane 210 within the neck 205 prevents its accidental engagement with foreign objects, and thereby prevents accidental rupture thereof and leakage of the contents of the bottle 200.

In a constructional model of the dispenser 100, the mounting bracket 101 and the cover plate 190 are preferably formed of metal; the soap container 130 is preferably formed of transparent plastic, and the injection bottles 150 and 200 are preferably formed of a translucent plastic material. However, it will be appreciated that any other suitable materials may be used in the construction of the liquid soap dispensing system of the present invention.

The length of the piercing member 130 from the well bottom wall 127 to the point 139 is approximately 20.5 mm.; the piercing member 130 has an inner diameter which varies from approximately 7 mm. at the lower end thereof to approximately 6.3 mm. at the upper end thereof, the outer surface 133 having an outer diameter of approximately 8.5 mm. and the outer surface 134 having an outer diameter of approximately 8 mm.; the channels between the dividers 135 and 136 are approximately 2 mm. wide and the drain holes 128 have diameters of between 1 and 2 mm. The inner diameters of the necks 155 and 205 of the injection bottles 150 and 200 are approximately 13 mm., while the maximum outer diameters of the ribs 158 and 208 are approximately 21 mm., the inner diameter of the well side wall 126 being approximately 20 mm.

From the foregoing, it can be seen that there has been provided an improved liquid soap dispensing system which features a refillable dispensing container providing anti-bootleg features to prevent refilling with soap other than from a predetermined type of refill container.

More particularly, there has been provided a soap dispensing system of the character described, wherein the dispensing container has a refill well provided with a hollow tubular piercing member, the refill injection cartridge comprising a plastic squeeze-bottle with a neck closed by a closure member recessed therein to protect against accidental rupture, the closure member being pierced by the hollow piercing member on insertion into the well to permit the liquid soap to flow through the hollow piercing member into the container.

In addition, there has been provided a liquid soap dispensing system of the type set forth, wherein the piercing member is provided with dividers to inhibit the flow of liquid soap therethrough at equal pressures inside and outside the container and to prevent coring of the refill bottle closure member when it is pierced by the piercing member.

There has also been provided a liquid soap dispensing system of the type set forth wherein the bottle neck is closed by a plug including a cylindrical sleeve having a closure member at its inner end, the sleeve sealing against the piercing member to prevent the flow of liquid soap around the outside of the hollow piercing member.

There has also been provided a novel method of forming the injection cartridge by ultrasonically welding the plug in place after the cartridge is filled.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A liquid soap dispensing system comprising a soap injection cartridge containing liquid soap and having a cylindrical neck terminating at a discharge end, a closure member disposed within and sealing said neck and spaced from said discharge end inwardly of said neck for protection against accidental rupture, dispensing apparatus including a closed wall structure defining a soap container from which soap is to be dispensed, said wall structure having a refill aperture therethrough dimensioned to inhibit the flow of liquid soap therethrough at equal pressure on both sides of said wall structure, and piercing member carried by said container and projecting outwardly therefrom adjacent to said refill aperture for entering said neck from said discharge end and piercing said closure member, said soap injection cartridge including means for placing the soap therein under pressure greater than that in said container for forcing the liquid soap through said refill aperture at a substantial rate after piercing of said closure member.

2. The liquid soap dispensing system set forth in claim 1, wherein said closure member is spaced from said discharge end of said neck a distance approximately equal to the inner diameter of said neck.

3. The liquid soap dispensing system set forth in claim 1, wherein the inner diameter of said neck is many times greater than the thickness of said closure member.

4. The liquid soap dispensing system set forth in claim 1, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well centrally thereof and extending therefrom outwardly of said well, said neck being receivable in said well for receiving said piercing member in said neck.

5. The liquid soap dispensing system set forth in claim 1, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well centrally thereof and extending therefrom outwardly of said well, said neck being receivable in said well for receiving said piercing member in said neck, said neck including a plurality of longitudinally spaced-apart annular sealing ribs extending radially outwardly therefrom for sealing engagement with the inner surface of said side wall of said well when said neck is inserted into said well.

6. A liquid soap dispensing system comprising a soap injection cartridge containing liquid soap and having a cylindrical neck terminating at a discharge end, a generally cylindrical sleeve extending into said neck coaxially therewith and fixedly secured thereto at the discharge end thereof around the entire perimeter thereof in a fluid-tight sealing relationship therewith, said sleeve having a closure wall integral with and closing the inner end thereof for cooperation therewith to seal said neck and spaced from said discharge end inwardly of said neck for protection against accidental rupture, dispensing apparatus including a closed wall structure defining a soap container from which soap is to be dispensed, said wall structure having a refill aperture therethrough dimensioned to inhibit the flow of liquid soap therethrough at equal pressure on both sides of said wall structure, and a piercing member carried by said container and projecting outwardly therefrom adjacent to said refill aperture for entering said neck and said sleeve from said discharge end and piercing said closure wall, said soap injection cartridge including means for placing the soap therein under pressure greater than that in said container for forcing the liquid soap through said refill aperture at a substantial rate after piercing of said closure wall.

7. The liquid soap dispensing system set forth in claim 6, wherein said sleeve extends into said neck a distance approximately equal to the inner diameter of said neck.

8. The liquid soap dispensing system set forth in claim 6, wherein said sleeve includes a radially outwardly extending annular flange at the outer end thereof overlying and fixedly secured to the discharge end of said neck.

9. A liquid soap dispensing system comprising a soap injection cartridge containing liquid soap and having a cylindrical neck terminating at a discharge end, a generally cylindrical sleeve extending into said neck coaxially therewith and fixedly secured thereto at the discharge end thereof around the entire perimeter thereof in a fluid-tight sealing relationship therewith, said sleeve having a closure wall integral with and closing the inner end thereof for cooperation therewith to seal said neck and spaced from said discharge end inwardly of said neck for protection against accidental rupture, dispensing apparatus including a closed wall structure defining a soap container from which soap is to be dispensed, said wall structure having a refill aperture therethrough dimensioned to inhibit the flow of liquid soap therethrough at equal pressure on both sides of said wall structure, and a hollow piercing member carried by said container and projecting outwardly therefrom for entering said sleeve in sealing engagement therewith from said discharge end of said neck and piercing said closure wall, said hollow piercing member being disposed in surrounding relationship with said refill aperture for cooperation therewith to define a refill passage, said soap injection cartridge including means for placing the soap therein under pressure greater than that in said container for forcing the liquid soap through said refill passage at a substantial rate after piercing of said closure wall.

10. The liquid soap dispensing system set forth in claim 9, and further including dividing structure carried within said hollow piercing member for dividing said refill passage into a plurality of channels, each of said channels being dimensioned substantially to inhibit the flow therethrough of liquid soap of the consistency to be dispensed at equal pressures at both ends of said channel.

11. The liquid soap dispensing system set forth in claim 9, and further including dividing means carried within said hollow piercing member adjacent to the outer end thereof for dividing said refill passage into a plurality of channels, said dividing means being arranged effectively to prevent any portion of said closure wall from entering and clogging said hollow piercing member when pierced thereby.

12. The liquid soap dispensing system set forth in claim 9, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well and extending therefrom outwardly of said well and coaxially therewith, said neck being receivable in said well for receiving said piercing member in said neck.

13. The liquid soap dispensing system set forth in claim 9, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well and extending therefrom outwardly of said well and coaxially therewith, said neck being receivable in said well for receiving said piercing member in said neck, said end wall portion of said well having a plurality of drain openings therethrough communicating with the interior of said container between said piercing member and said side wall of said well.

14. The liquid soap dispensing system set forth in claim 9, wherein said piercing member is substantially circular in transverse cross section and has a generally cylindrical outer surface, said outer surface having a first portion with an outer diameter slightly less than the inner diameter of said sealing sleeve and a second portion with an outer diameter substantially equal to the inner diameter of said sealing sleeve for sealing engagement therewith.

15. A liquid soap injection cartridge for use in refilling a liquid soap dispenser container having a refill aperture dimensioned to inhibit the flow of liquid soap therethrough at equal pressure on the inside and outside of the container and a piercing member carried by the container and projecting outwardly therefrom adjacent to the refill aperture, said cartridge comprising a liquid soap refill vessel having a cylindrical neck terminating at a discharge end, a closure member disposed within and sealing said neck and spaced from said discharge end inwardly of said neck for protection against accidental rupture, said neck being dimensioned for simultaneously encircling the associated refill aperture and piercing member while receiving the piercing member therein from said discharge end for piercing said closure member, said refill vessel including means for placing the soap therein under pressure greater than that in the associated container for forcing the liquid soap through the associated refill aperture at a substantial rate after piercing of said closure member.

16. The liquid soap injection cartridge set forth in claim 15, wherein said refill vessel comprises a soft plastic squeeze bottle.

17. The liquid soap injection cartridge set forth in claim 15, wherein said closure member is spaced from said discharge end of said neck a distance approximately equal to the inner diameter of said neck.

18. A liquid soap injection cartridge for use in refilling a liquid soap dispenser container having a refill aperture dimensioned to inhibit the flow of liquid soap therethrough at equal pressure on the inside and outside of the container and a piercing member carried by the container and projecting outwardly therefrom adjacent to the refill aperture, said cartridge comprising a liquid soap refill vessel having a cylindrical neck terminating at a discharge end, a generally cylindrical sleeve extending into said neck coaxially therewith and fixedly secured thereto at the discharge end thereof around the entire perimeter thereof in a fluid-tight sealing relationship therewith, said sleeve having a closure wall integral with and closing the inner end thereof for cooperation therewith to seal said neck and spaced from said discharge end inwardly of said neck for protection against accidental rupture, said sleeve being dimensioned to simultaneously encircle the associated refill aperture and piercing member with the piercing member being received therein from said discharge end for piercing said closure wall, said refill vessel including means for placing the soap therein under pressure greater than that in the associated container for forcing the lqiuid soap through the associated refill aperture at a substantial rate after piercing of said closure wall.

19. The liquid soap injection cartridge set forth in claim 18, wherein said sleeve extends into said neck a distance approximately equal to the inner diameter of said neck.

20. The liquid soap injection cartridge set forth in claim 18, wherein said sleeve includes a radially outwardly extending annular flange at the outer end thereof overlying and fixedly secured to the discharge end of said neck.

21. A refillable liquid soap dispenser adapted for use with a soap injection cartridge having a cylindrical neck terminating at a discharge end and means for placing the liquid soap therein under pressure greater than that outside the cartridge and including a cylindrical sleeve sealed to the neck around the perimeter thereof and extending axially thereinto and closed at the inner end thereof by a closure wall, said dispenser comprising a closed wall structure defining a soap container, dispensing means carried by said soap container for dispensing soap therefrom, said wall structure having a refill aperture therethrough, a hollow piercing member carried by said container and projecting outwardly therefrom for entering the sleeve of the associated container in sealing engagement therewith from the discharge end of the neck for piercing the associated closure wall, said hollow piercing member being disposed in surrounding relationship with said refill aperture for cooperation therewith to define a refill passage, and dividing structure carried within said hollow piercing member for dividing said refill passage into a plurality of channels, each of said channels being dimensioned substantially to inhibit the flow therethrough of liquid soap of the consistency to be dispensed at equal pressures at both ends of said channel, whereby liquid soap in the associated injection cartridge may be placed under pressure greater than that in said container and forced through said refill passage at a substantial rate after piercing the associated closure wall while being prevented from flowing around the outside of said piercing member by the sealing engagement thereof with the sleeve of the associated injection cartridge.

22. The refillable liquid soap dispenser set forth in claim 21, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well and extending therefrom outwardly of said well and coaxially therewith, said neck being receivable in said well for receiving said piercing member in said neck.

23. The fillable liquid soap dispenser set forth in claim 21, wherein said closed wall structure has a recessed portion forming a well including a cylindrical side wall extending inwardly of said container and a circular end wall closing said side wall at the inner end thereof, said refill aperture being formed in said circular end wall of said well, said piercing member being carried by said circular end wall of said well and extending therefrom outwardly of said well and coaxially therewith, said neck being receivable in said well for receiving said piercing member in said neck, said end wall portion of said well having a plurality of drain openings therethrough communicating with the interior of said container between said piercing member and said side wall of said well.

24. A method for forming an injection cartridge for use in refilling liquid soap dispensing containers, said method comprising the steps of providing a plastic squeeze bottle having a cylindrical neck terminating at a discharge end and defining a flow passage communicating with the interior of the bottle, filling the bottle with liquid soap through said neck, then inserting coaxially into said neck a cylindrical plastic sleeve closed at the inner end thereof by a thin closure wall, and then ultrasonically welding said plastic sleeve to said neck around the entire perimeter thereof for forming a fluid-tight closure for said bottle.

25. The method set forth in claim 24, wherein said plastic sleeve is welded to said neck at the discharge end thereof.

* * * * *